US005657708A

United States Patent [19]

Okuno et al.

[11] Patent Number: 5,657,708

[45] Date of Patent: Aug. 19, 1997

[54] EMBROIDERING MACHINE CONTROLLER

[75] Inventors: Akira Okuno, Yokohama; Youichi Ishibashi; Toshihiro Makita, both of Tokyo, all of Japan

[73] Assignee: Nippon Denpa Co., Ltd., Tokyo, Japan

[21] Appl. No.: 513,876

[22] PCT Filed: Jan. 26, 1995

[86] PCT No.: PCT/JP95/00089

§ 371 Date: Sep. 19, 1995

§ 102(e) Date: Sep. 19, 1995

[87] PCT Pub. No.: WO95/20701

PCT Pub. Date: Aug. 3, 1995

[30] Foreign Application Priority Data

Jan. 26, 1994 [JP] Japan ..... 6-023630

[51] Int. Cl.[6] ..... D05B 19/12

[52] U.S. Cl. ..... 112/102.5; 112/445; 112/458; 112/470.04

[58] Field of Search ..... 112/102.5, 470.06, 112/470.04, 470.01, 445, 458, 456; 364/470

[56] References Cited

U.S. PATENT DOCUMENTS

| | | | |
|---|---|---|---|
| 4,860,678 | 8/1989 | Skogward | 112/445 |
| 4,943,906 | 7/1990 | Tajima et al. . | |
| 5,097,779 | 3/1992 | Ishikawa et al. | 112/445 |
| 5,333,560 | 8/1994 | Yoshida | 112/445 X |
| 5,347,940 | 9/1994 | Hori et al. | 112/445 X |

FOREIGN PATENT DOCUMENTS

| | | |
|---|---|---|
| 29 43 664 | 8/1980 | Germany . |
| 29 44 071 | 5/1981 | Germany . |
| 38 23 562 | 2/1989 | Germany . |
| 38 33 605 | 4/1989 | Germany . |

*Primary Examiner*—Peter Nerbun

*Attorney, Agent, or Firm*—Oblon, Spivak, McClelland, Maier & Neustadt, P.C.

[57] ABSTRACT

An embroidering machine controller which can be operated with improved operability even by unskilled operators or by operators of foreign nationalities despite language barriers, if any. The controller (12) is provided with exclusive pictorial switch keys (21A to 21J) and auxiliary switch keys (22A to 22D) on its operating panel (14). The faces of the exclusive pictorial switch keys (21A to 21J) bear graphic symbols indicative of the contents of exclusively allotted commands. The auxiliary switch keys (22A to 22D) are selectively allotted with commands in relation with and in submission to a keying operation on one of the exclusive pictorial switch keys (21A to 21J). Graphic symbols of the commands which are currently allotted to the respective auxiliary switch keys (22A to 22D) are shown in a menu area (15A) on the viewing screen of a display means (15). In addition, a corresponding graphic symbol is shown as a guide message in a message area (15B) of the display screen in response to a keying operation.

4 Claims, 11 Drawing Sheets

EMBROIDERING MACHINE CONTROLLER

TECHNICAL FIELD

This invention relates to an embroidering machine controller suitable for use with an industrial sewing machine, for example, with an automatic embroidering machine, and more particularly to an embroidering machine controller which is capable of controlling operations of such automatic embroidering machines with improved operability.

BACKGROUND ART

Among various industrial sewing machines, there have been known in the art the so-called multi-head automatic embroidering machines which have a plural number of machine heads side by side on and along a wide support table, and which are arranged to put the embroidering needles on the respective machine heads in reciprocating motions in a synchronized fashion by means of a single common drive source to form simultaneously a plural number of embroidery patterns or stitches on a spread of cloth which is retained in a movable cloth holder frame on the support table.

Existing multi-head automatic embroidering machines of this sort generally include various drive mechanisms and servo mechanisms, for example, a main shaft drive motor serving as a common drive source to drive the respective embroidering needles up and down in reciprocating motions, actuators for shifting the cloth holder frame position, mechanisms for changing the color of embroidering threads, mechanisms for cutting embroidering threads, sensors for detection of embroidering thread breakages etc. In forming embroidery patterns and stitches, automatic embroidering machines of this sort invariably need to control these mechanisms according to setup operational data.

In this regard, for centralized control of a large number of functions involved in embroidering operations, multi-head automatic embroidery machines are normally provided with a controller which is exclusively tailored to each model of embroidering machine. In most cases, the controller is largely constituted by; a display means with a viewing screen for visually indicating operational information or message such as drive conditions, operation menu and others; a plural number of manual switch keys for entering commands or other data for the operation of the embroidering machine; a disk drive for uploading and downloading files of operational data including embroidering data; and a microcomputer for generally controlling a large number of functions as mentioned above.

For instance, the controller is used to set up operational data by reading in a specified file of embroidering data (embroidery pattern generating data) from a floppy disk on the disk drive, and to control automatically the operations of moving parts of the embroidering machine according to setup embroidering data to produce aimed embroidery patterns at the respective machine head. Besides, it is usually the case that the operator can remote-control the frame driving actuators and color changing mechanisms arbitrarily at a desired time point in the course of an embroidering operation by way of the manual switch keys on the controller, which also include manual switch keys with functions of adding modifications or alterations to the embroidery pattern in the uploaded embroidering data file or other functions.

In case of an embroidering machine controller of this sort, it is impractical to provide on the controller a large number of function selector switches in one-on-one relation with all of the numerous functions which are resorted to in the control of embroidering operations, in consideration of the inferior operationability as would result from complications of switching (keying) operations involving a large number of function selector keys (switches). In order to reduce the number of function selector keys, it has been the general practice to divide the numerous functions into a plural number of selection groups (selection modes) which are convenient to the operator in terms of keying-in operations, and to allot the functions of the each selection group selectively to a reduced number of function selector keys in relation with a keying operation on a group selector key (switch) which switches the accessible selection group. In this case, it becomes possible to allot a plural number of functions of different groups to each one of the function selector keys. For example, in many cases a group selector key is provided on the controller for toggling the accessible function group between Group A consisting of a collection of functions to be used during an actual embroidering operation and Group B consisting of a collection of functions to be used in a preparatory setup stage prior to starting an embroidering operation. In this way, for the purpose of attaining higher operationability of the embroidery machine controller, attempts have thus far been made to reduce the number of function selector keys (switches) through group-by-group allocations of a large number of functions to the respective function selector keys on the controller.

Nevertheless, each time the selection group is switched from one group to another, the operator needs to know what functions are currently allotted to the respective function selector keys which are each assigned with a plural number of functions of different groups. In this regard, prior art embroidering machine controllers are mostly provided with a display means to show in characters a menu of functions which are currently allotted to the respective function selector keys or a guide message pertaining to a keying operation, so that under the guidance of the function menu and the guide message on the display, the operator can press the function selector keys to complete intended data setting jobs.

Namely, according to the above-described prior art embroidering machine controller, a large number of functions involved in embroidering operations are divided into groups and allotted group by group to a reduced number of function selector keys to simplify the keying (switching) operation in selecting a desired function, while indicating on a character display a menu of functions currently allotted to the respective function selector keys along with a guide message pertaining to a keying operation on the function selector keys to keep the operator posted of the progresses and results of keying operations.

However, these function menu and operational guide messages are normally indicated in characters on the display and their contents are renewed on each keying (switching) operation, so that the operator may not be able to find correct keys unless he or she is conversant with the language used in the menu and guide messages. Therefore, the operator needs to be a skilled person to perform the keying operations smoothly. In other words, the keying operations could be too difficult for an unskilled operator.

Besides, in case of the prior art embroidering machine controller which is arranged to show a function menu and a guide message in characters on a display screen, there inevitably arises a necessity for adapting the language in the menu and messages to the mother tongue of a country where the controller is to be used. However, a great deal of labor and time is required to change the specifications of the controller into conformity with the mother tongue of an operator or with the language of a country of use.

In a data setting device disclosed in Japanese Laid-Open Patent Application No. Heil-166797 or its corresponding U.S. Pat. No. 4,943,906 (hereinafter referred to as "the other prior art controller" for brevity), this problem is coped with by providing a few (e.g., six) function selector keys (switches) for setting and keying in various operational data, in combination with a function menu switching key to be pressed by the operator for changing the allocation of functions to the respective function selector keys, and a display with six square sections on its screen to show pictorial symbols of functions currently allotted to the respective function keys. Each time the menu switching key is pressed, the allocation of functions to the respective function selector keys is shifted cyclically from first six functions to second six functions and so forth.

In this case, the function menu which is shown on the display screen consists of pictorial symbols of the functions which are currently allotted to the function selector keys, so that the operator can visually grip the current status of the respective function selector keys at the time of each keying operation regardless of the mother tongue of the operator.

However, in a keying operation for selecting an aimed function, the menu switching key of the just-mentioned other prior art controller is useful simply for combing through menu pages in which six different functions are allotted to the respective function keys sequentially from the numerous functions of an embroidering machine without any systematically organized links with each other and with the respective function selector keys. Therefore, the operator is often required to press the menu switching key repeatedly for many times looking for an aimed function among the pictorial symbols of the functions which are sequentially and cyclically shown on the display screen, paying great efforts just for finding a key of an aimed function. In addition, although the other prior art controller is arranged to show on the display a pictorial menu of the functions which are currently allotted to the respective function selector keys, it still requires the operator to check with eyes all of the pictorial symbols of the functions on the menu repeatedly while renewing the contents of the menu by pressing the menu switching key, failing to achieve improvements in operationability to any significant degree.

DISCLOSURE OF INVENTION

In view of the above-discussed problems of the prior art, it is an object of the present invention to provide an embroidering machine controller, which can simplify switching (keying) operations in data setup processes by allotting major functions, which are used most frequently among numerous functions necessary for controlling operations of an embroidering machine, exclusively and systematically to a reduced number of exclusive pictorial switch keys which can be operated by an operator easily in a well oriented fashion irrespective of his or her mother tongue.

In accordance with the present invention, the above-stated objective is achieved by the provision of an embroidering machine controller, comprising; a memory means storing a large number of commands in control of various functions necessary for controlling operations of an embroidering machine; a plural number of exclusive pictorial switch keys allotted exclusively with most frequently used commands among the large number of commands stored in the memory means and each bearing a pictorial symbol of an exclusively allotted command on a face thereof; a plural number of auxiliary switch keys selectively allotted with the remainder of the large number of commands, other than the commands allotted to the exclusive pictorial switch keys, in relation with and in submission to a keying operation on one of the exclusive pictorial switch keys; a display means having a menu area on a viewing screen to show a menu of commands allotted to the respective auxiliary switch keys in response to a keying operation on one of the exclusive pictorial switch keys; and a graphic menu generating means for generating in the menu area of said displaying means a set of graphic symbols of the commands currently allotted to the respective auxiliary switch keys in positions corresponding to the latter.

With the above-described arrangements, the functions (commands) which are frequently or regularly used in controlling embroidering and stitching operations of an embroidery machine are exclusively allotted to the exclusive pictorial switch keys, so that the operator of the embroidering machine can easily get to and execute a desired command simply by pressing a corresponding one of the exclusive pictorial switch keys, which respectively bear pictorial or graphic symbols of the exclusively allotted functions on their faces.

Upon pressing an exclusive pictorial key, a set of predetermined commands, belonging to a family represented by the pressed exclusive pictorial key, are allotted to the respective auxiliary keys. Simultaneously, by the graphic menu generating means, a set of graphic symbols corresponding to the allotted commands are shown in the menu area of the display means positionally in one-on-one relation with the auxiliary switch keys as a menu of the commands or functions which can be currently selected through the auxiliary switch keys. Consequently, the operator can instantly grip what sort of commands are currently allotted to the respective auxiliary keys and which key should be pressed to start a desired function.

In this instance, the display means is preferred to have a message area on the viewing screen outside the above-mentioned menu area, for the purpose of displaying a guide message pertaining to a selected command, and a graphic message generating means which is adapted to produce a graphic message in the message area of the display in response to a keying operation either on one of the exclusive pictorial switch keys or on one of the auxiliary switch keys.

In case the display means is arranged in this manner, a graphic guide message responsive to a keying operation on an exclusive pictorial switch key or on an auxiliary switch key is shown in the message area of the display means by the graphic message generating means, so that the operator can easily check with the graphic message for the contents of a keyed-in command or for the current operating conditions of the embroidering machine.

Further, in addition to a graphic guide message symbolic of a selected command itself, arrangements may be made to show the meaning or contents of a selected command by adding simple universally comprehensible letters, figures or characters to the message area of the display means, if necessary.

In case a graphic message in the message area of the display means is accompanied by universally comprehensible letter or figures indicative of the meaning and contents of the message, it becomes easier for the operator to understand the displayed message more correctly.

The exclusive pictorial switch keys are each allotted with a command for calling exclusively a regularly resorted function or a regularly resorted function family, for example, a function or a function family pertaining to "Data Input/Output Control", "Embroidery Pattern Data Selection", "Manual Operation", "Void Stitching", "Main Shaft Motor Control", "Color Change", "Thread Cutting", "High Speed Color Change" and "Operation Mode Switching", and each one of the exclusive pictorial switch key bears on its top face a pictorial or graphic symbol indicative of its allotted function or function family.

With such arrangements, the exclusive pictorial switch keys can be used exclusively for at least nine most frequently used commands to make it easier for the operator to key in necessary data in setup operations connected with selection of an embroidery pattern number, motor speed setting, color change, thread cutting, machine operation control etc.

BEST MODE FOR CARRYING OUT THE INVENTION

Figure 1:
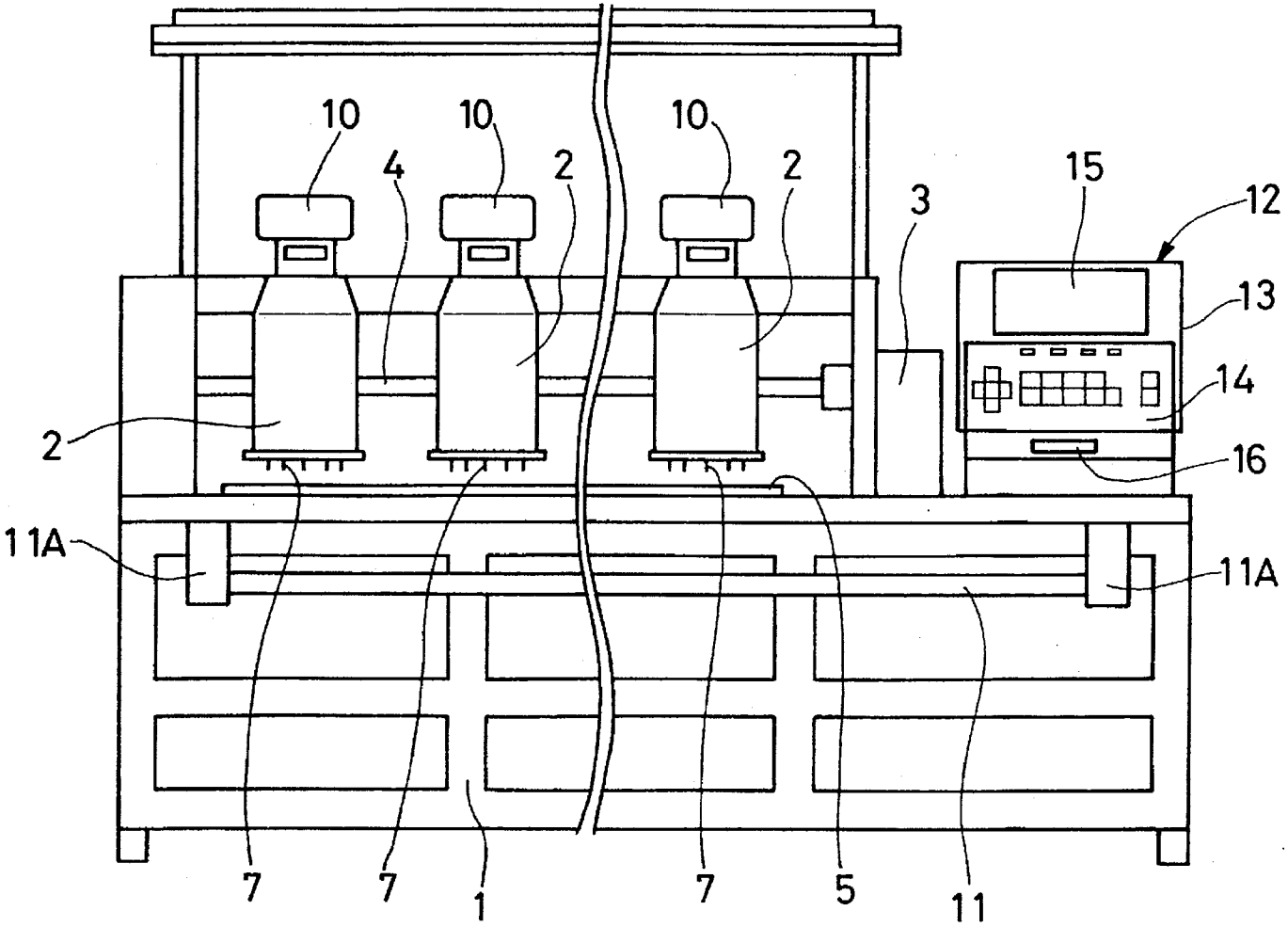
FIG. 1 is a schematic view of a multi-head automatic embroidering machine and an embroidering machine controller according to the present invention.
Figure 2:
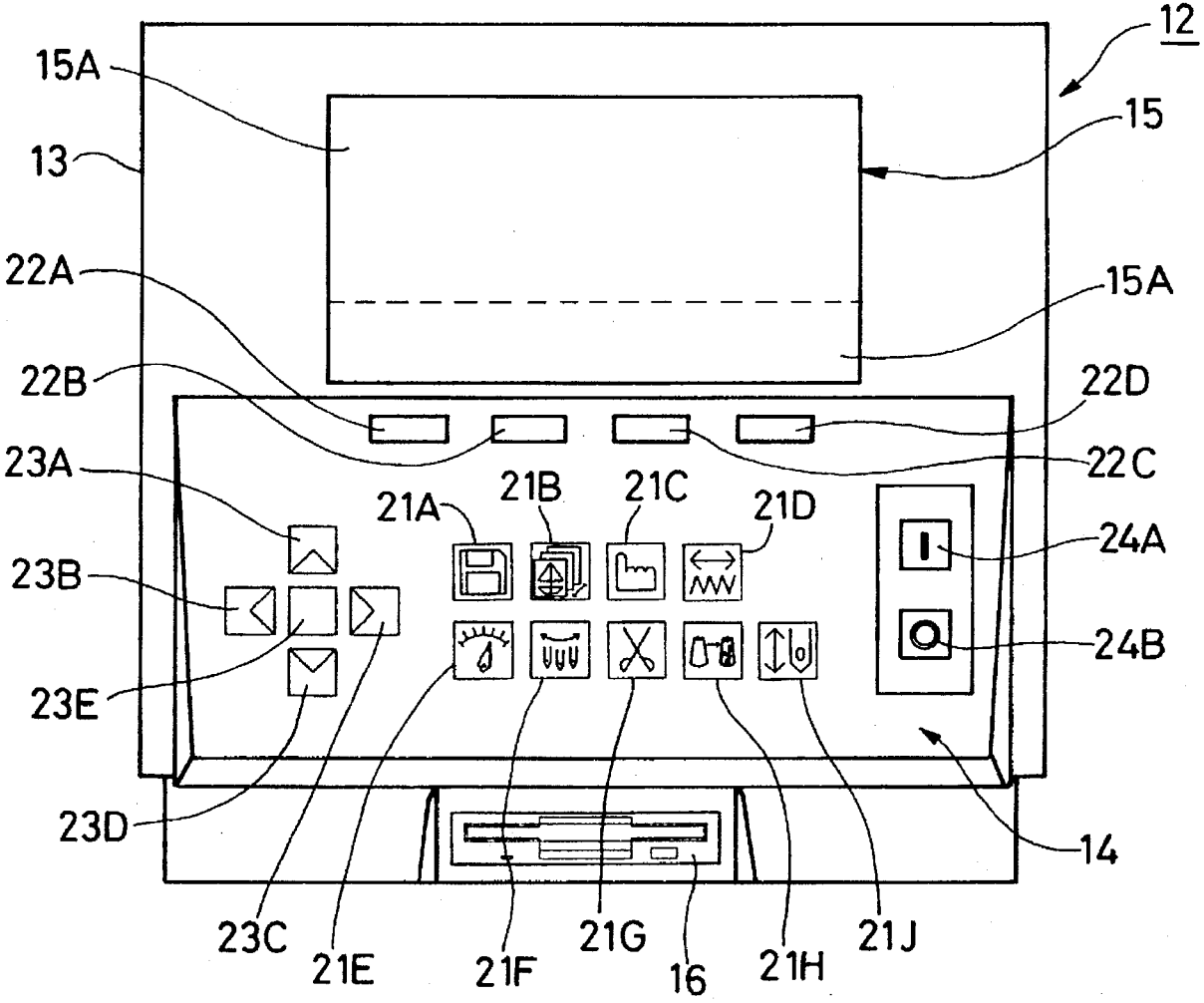
FIG. 2 is a schematic front view on an enlarged scale of the embroidering machine controller shown in FIG. 1.

Hereafter, the present invention is described more particularly by way of its preferred embodiments with reference to FIGS. 1 through 13. In the particular embodiment shown, this invention is applied to a controller of a multi-head automatic embroidering machine.

In the drawings, indicated at 1 is a support table having a large width in lateral directions to support thereon a plural number of machine heads 2 side by side at spaced positions along its width. A main shaft drive motor 3 is mounted on a right end portion of the support table 1 to serve as a common drive source for the respective machine heads 2. The embroidering machine is largely constituted by these support table 1, machine heads 2 and main shaft drive motor 3. The driving force of the main shaft motor 3 is transmitted to the respective machine heads 2 through a main shaft 4. The main shaft drive motor 3 is connected to a processor unit 18 which controls the operation of the main shaft motor 3, especially its rotational speed, as will be described hereinlater.

Denoted at 5 is a cloth holder frame which holds a spread of embroidering cloth on the support table 1. The just-mentioned cloth holder frame 5 is connected to frame driving actuators 6 for movements in back and forth and sideward directions. The frame driving actuators 6 are connected to and operated by control signals from the processor unit 18. Therefore, for example, as the holder frame 5 is moved to specific positions according to embroidery pattern data (embroidering data), a predetermined embroidery pattern based on the pattern data is produced by each machine head.

Indicated at 7 are a plural number of embroidering needles which are provided on the respective machine heads 2. Each embroidering needles 7 put in reciprocating motion at up- and -down directions by driving of the main shaft motor 3 and the handling of respective embroidering needles is conducted to the embroidering cloth holed at the cloth holder frame 5. Also, each machine head 2 is provided with a plural number of embroidering needles 7 for threads of different colors which are interchangeably set in position. By driving the color changing mechanism 8, one of the embroidering needles 7 is selectively set in operative position on each machine head 2 to produce embroidery patterns of various colors.

In this instance, each machine head 2 is provided with a thread cutting mechanism 9 in addition to the above-mentioned color changing mechanism 8. The color changing mechanism 8 and the thread cutting mechanism 9 are respectively connected to and operated by control signals from the processor unit 18.

Designated at 10 are thread guides which are mounted on top of the respective machine heads 2 to guide embroidering threads toward the needles 7 on the machine heads 2. Each one of the thread guides 10 is provided with a bobbin holder (not shown) on its rear side to support thereon a plural number of bobbins filled with threads of different colors (not shown) in a manner known in the art.

Provided on the front side of the support table 1 is an operation on-off rod 11 which serves as a manual switch for starting and stopping the operation of the embroidering machine. More specifically, the operation rod 11 is supported on the support table 1 by bracket members 11A which permit the operation rod 11 to slide to the right and left in a slight degree, for example, to start the operation of the embroidering machine when the rod 11 is pushed to the left by the operator and to stop the operation when the rod 11 is pushed to the right.

Indicated at 12 is an embroidering machine controller (hereinafter referred to simply as "controller 12" for brevity) which is mounted on the left side of the support table 1. The controller 12 is largely constituted by a main body 13 which is housed in a box-like casing, an operating panel 14 which is provided in a lower portion on the front side of the main body 13 and provided with a plural number of exclusive pictorial switch keys 21A to 21J and a plural number of auxiliary switch keys 22A to 22D as will be described in greater detail hereinlater, a display 15 which is provided on the operating panel 14, a disk drive 16 provided under the operating panel 14, a plural number of slots 17 for connection of external units, which is provided on the back side of the main body 13, and the afore-mentioned processor unit 18 which is provided internally of the main body of the controller 13 or on the rear side of the support table 1.

Figure 3:
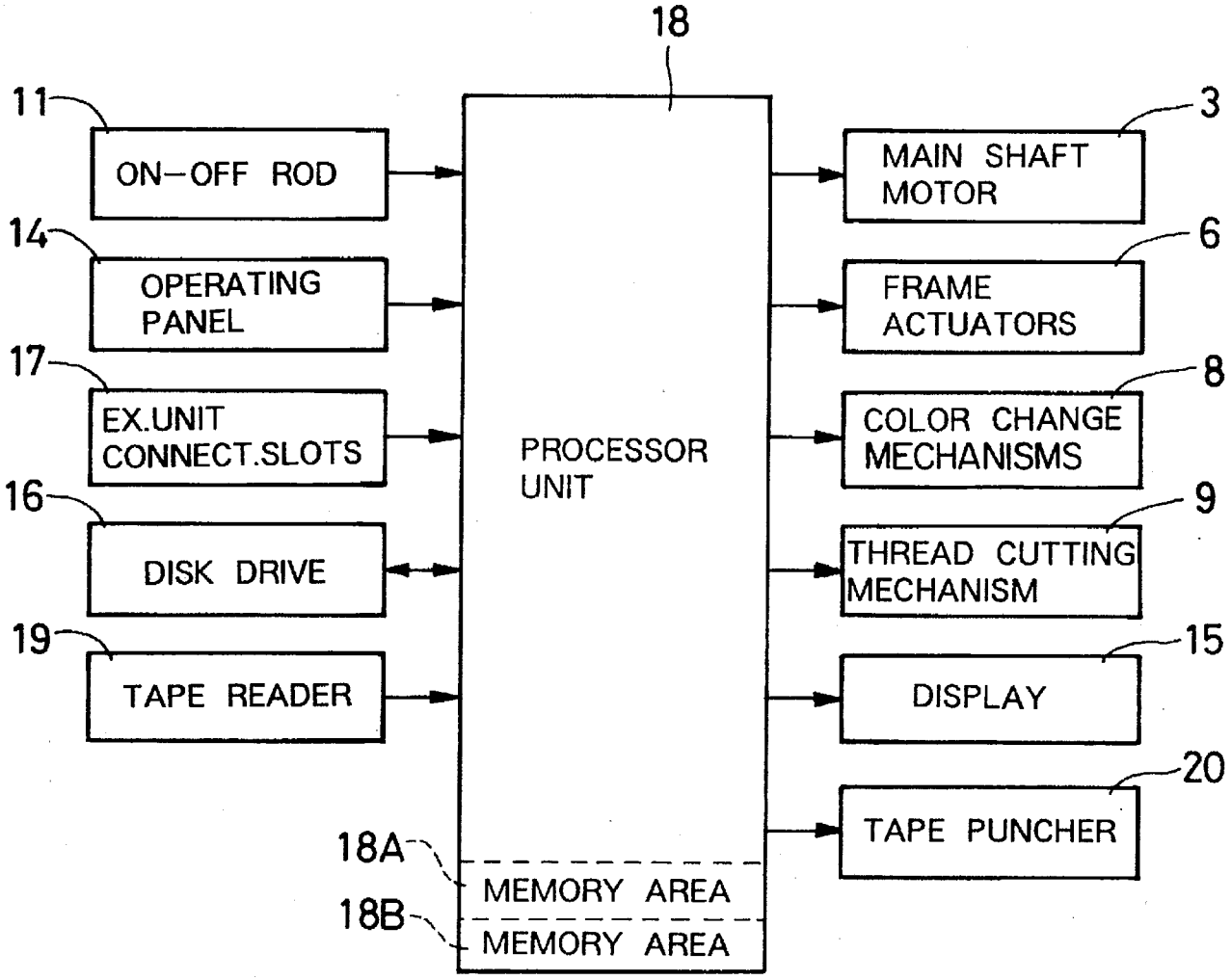
FIG. 3 is a block diagram of the embroidering machine controller shown in FIG. 2.

The above-mentioned processor unit 18 is largely constituted by a CPU and memory areas, and as shown in FIG. 3, includes input/output ports to connect thereto the afore-mentioned main shaft motor 3, frame driving actuators 6, color changing mechanism 8, thread cutting mechanism 9, operation on-off rod 11, operating panel 14 (including the exclusive pictorial keys 21A to 21J and auxiliary keys 22A to 22D etc), display 15, disk drive 16, tape reader 19, tape puncher 20 and so forth, through interfaces which are not shown.

Figure 4:
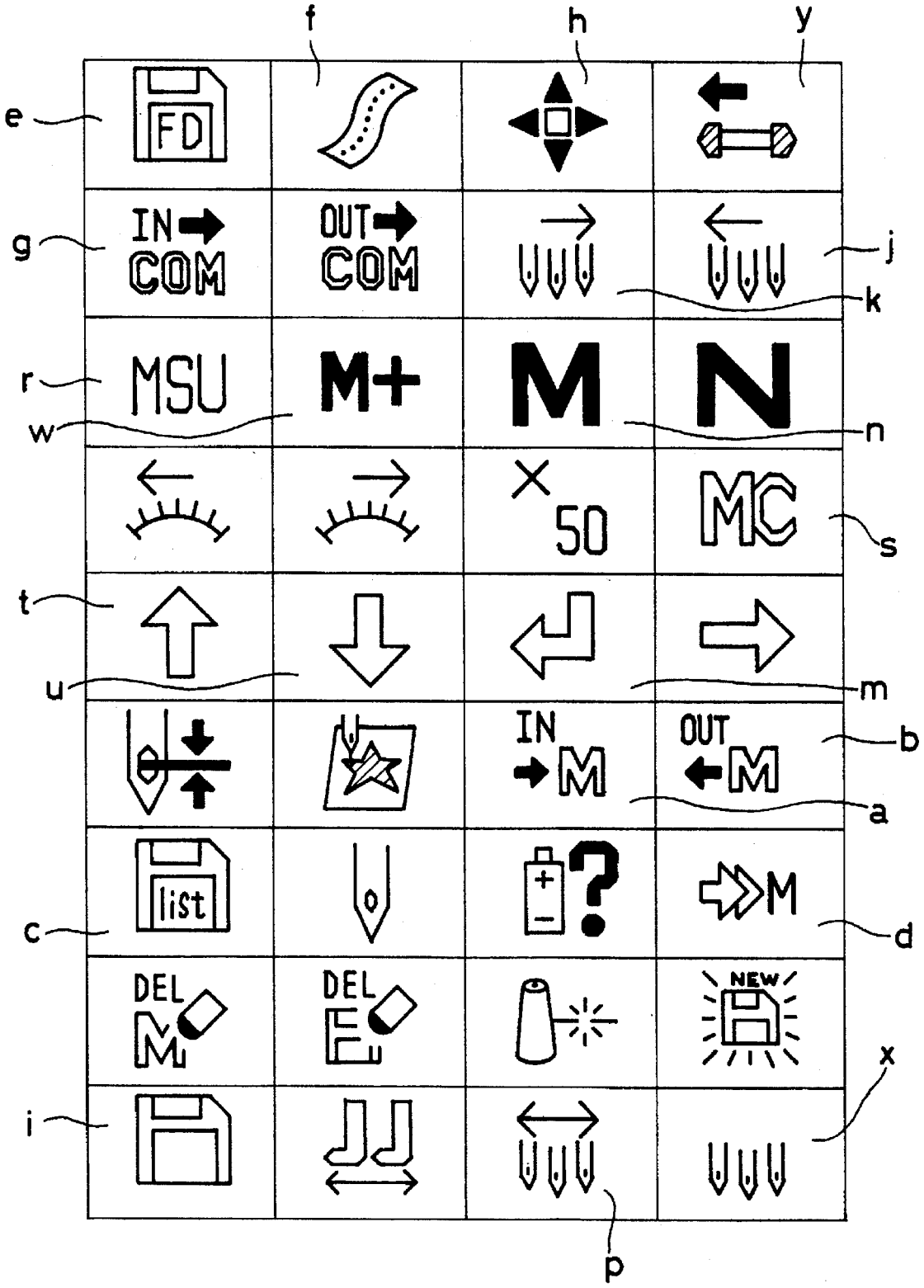
FIG. 4 is a diagrammatic illustration of graphic symbols stored in a memory area of a processing unit.
Figure 5:
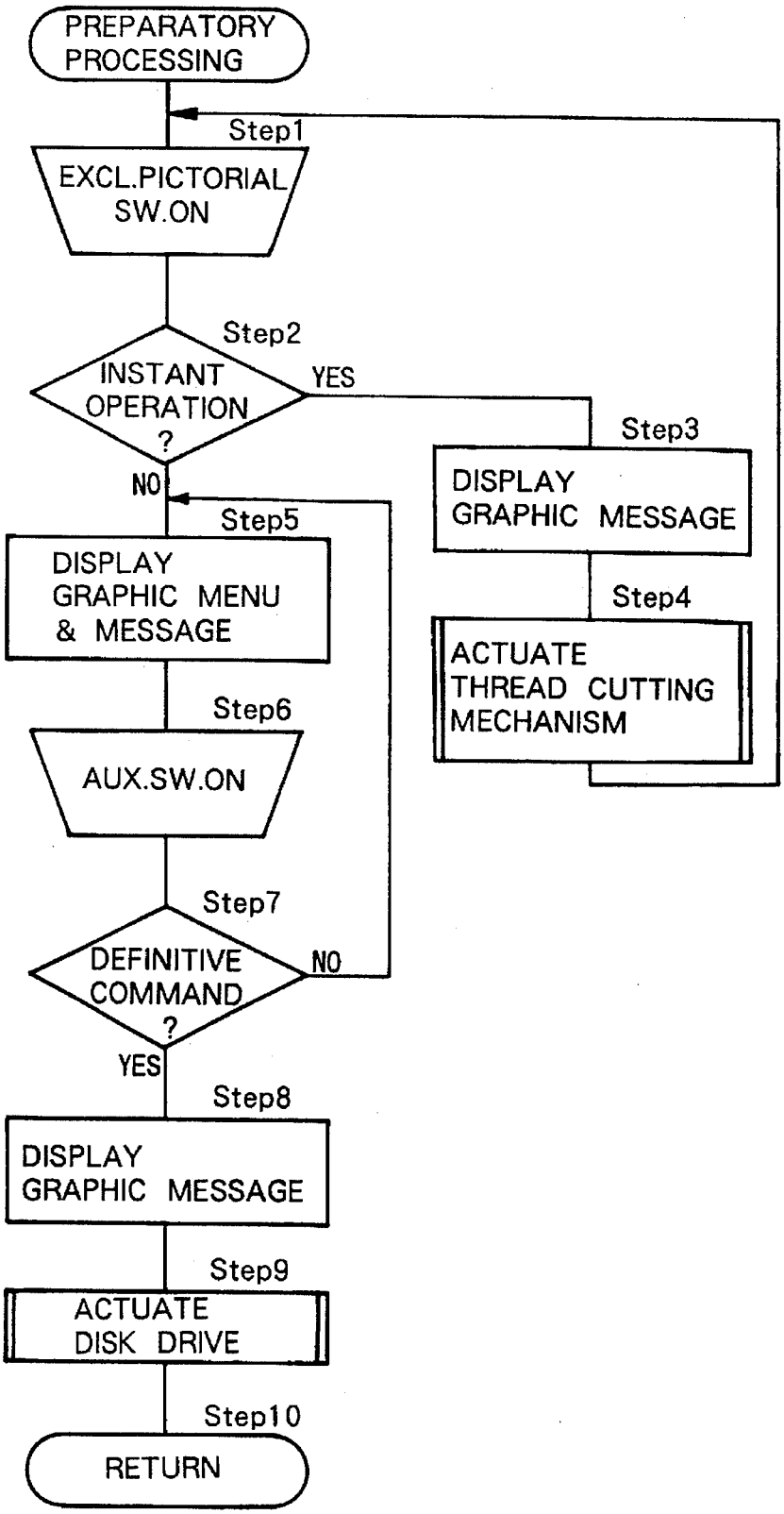
FIG. 5 is a flowchart of a preparatory setup process to be carried out prior to an embroidering operation.
Figure 6:
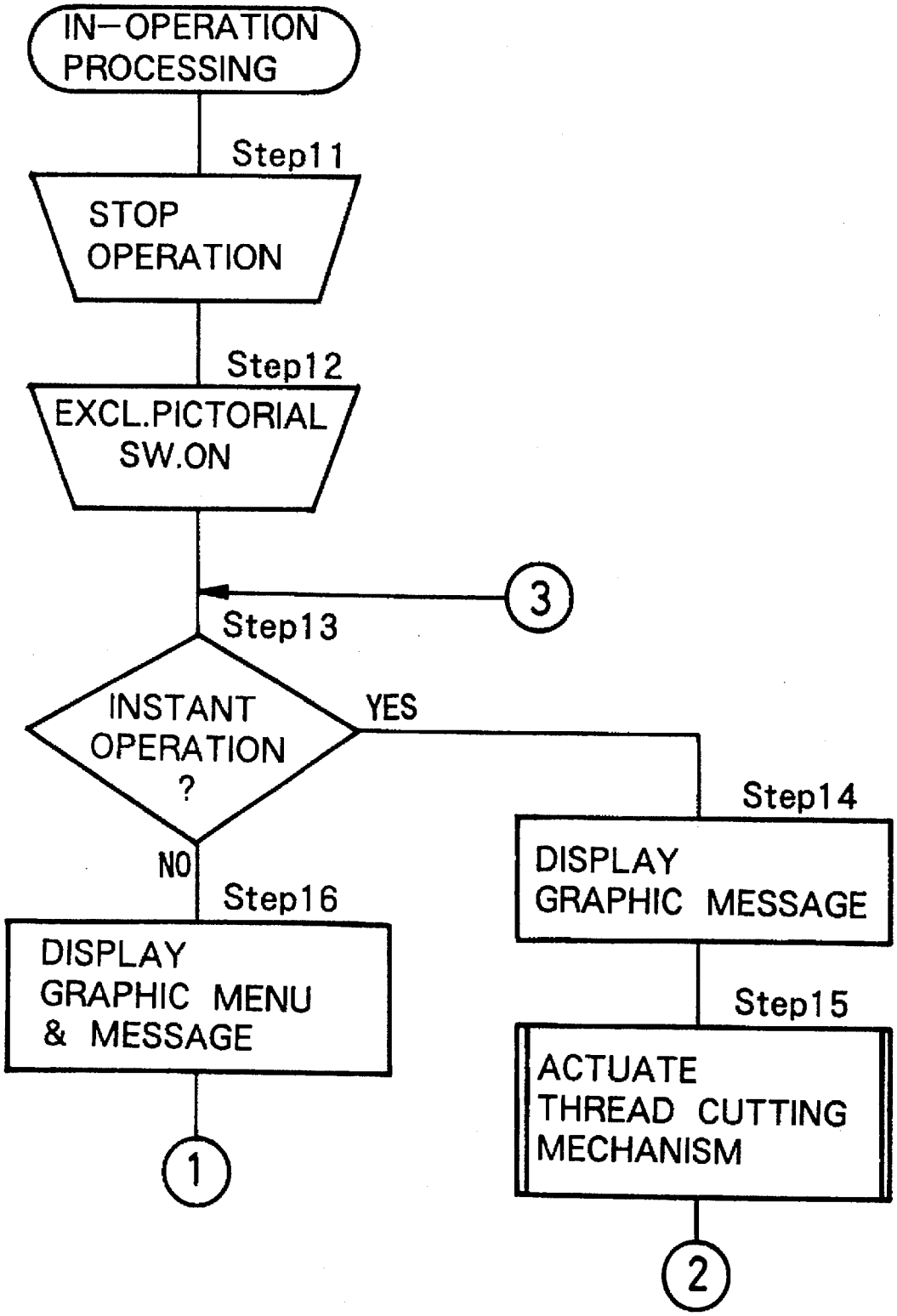
FIG. 6 is a flowchart of an in-operation setup process to be carried out in the course of an embroidering operation.
Figure 7:
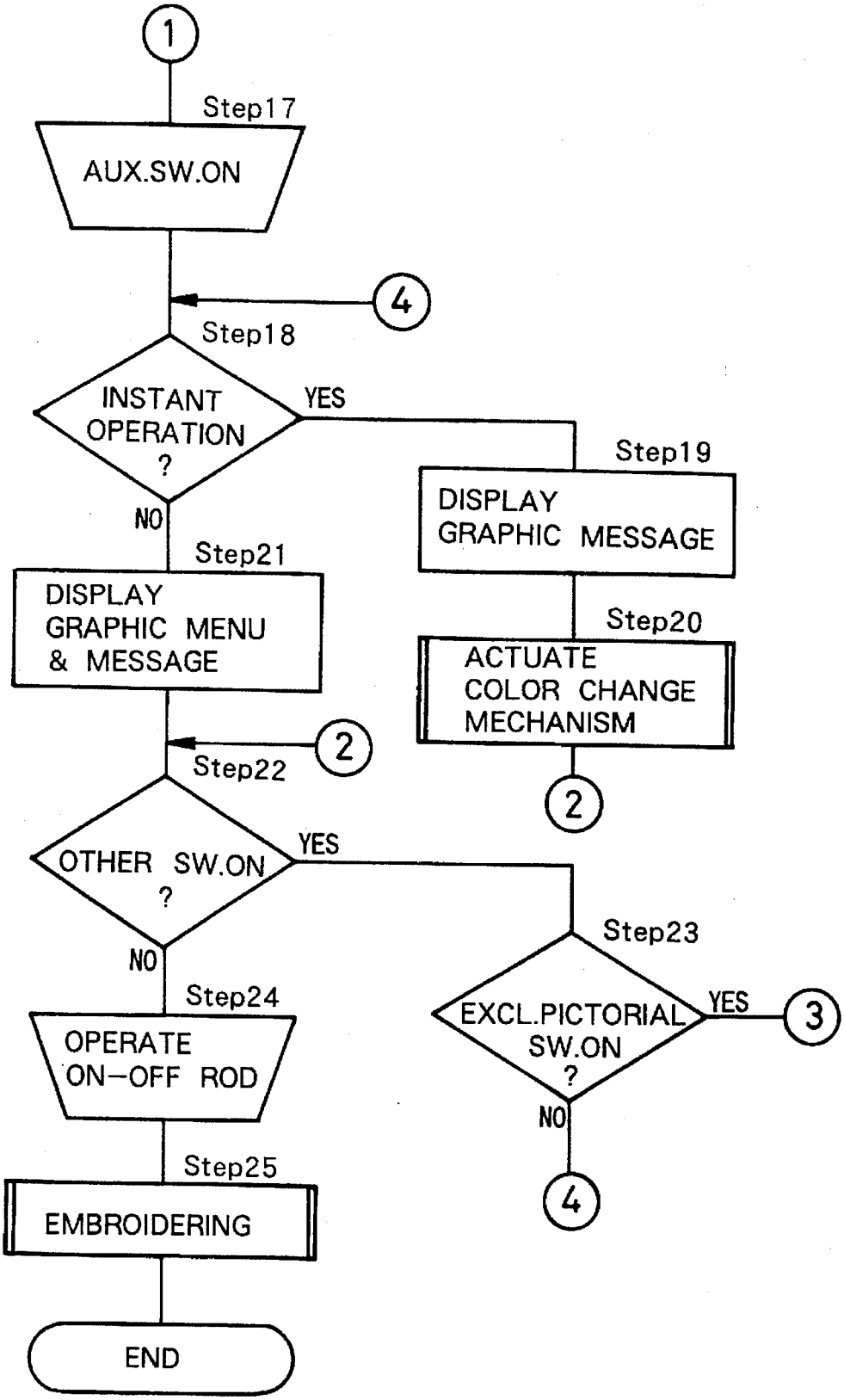
FIG. 7 is a flowchart of a process which is continued from FIG. 6.

The processor unit 18 is internally provided with a first memory area 18A consisting of a memory means such as ROM or the like, storing a large number of commands which are necessary for controlling the operations of the embroidering machine, graphic patterns or symbols (FIG. 4) indicative of the respective commands, processing programs as exemplified in FIGS. 5 to 7, and mechanical drive control programs for controlling, independently of each other, the drive mechanisms which are connected to the processor unit 18, including the main shaft drive motor 3 and the frame driving actuators 6. Further, the processor unit 18 is internally provided with a second memory area 18B consisting of a memory means such as RAM or the like capable of re-writably storing embroidering data such as embroidery pattern data files.

The disk drive 16 is provided for uploading an embroidery pattern data file to the second memory area 18B of the processor unit 18 from a floppy disk, and also for saving or downloading an embroidery pattern data file to a floppy disk from the memory area 18B. The tape reader 19 is provided for uploading an embroidery pattern data file on a punched tape to the memory area 18, while the tape puncher 20 serves for saving an embroidery pattern data file in the second memory area 18B to a punching tape. The processor unit 18 is further provided with external unit connection slots 17 of RS232 and SCSI standards, for use in case of data transmission between the processor unit 18 and other embroidering machine or external data storage device through a communication network.

The operating panel 14 and the display 15 of the controller 12 are arranged in the manner as follows.

At least the following switch keys are provided on the operating panel 14.

The nine (9) exclusive pictorial switch keys 21A to 21J on the top side of the operating panel 14 are exclusively allotted with nine most frequently used commands among the numerous commands stored in the memory area 18A of the processor unit 18. As seen from FIG. 2, the faces of these exclusive pictorial switch keys 21A to 21J bear pictorial or graphic symbols of the exclusively allotted commands, respectively.

More specifically, for instance, the exclusive pictorial key 21A is allotted with a command which calls in a family of functions pertaining to embroidery pattern data input/output operations, and bears on its face a graphic symbol indicative of such functions. For instance, the exclusive pictorial key 21A is pressed at the time of reading in or uploading an embroidery pattern data file from a floppy disk on the disk drive 16. Similarly, the exclusive pictorial key 21A is pressed at the time of uploading or downloading an embroidery pattern data file by the use of the tape reader 19 or the tape puncher 20.

Nextly, the exclusive pictorial switch key 21B is allotted with a command which calls in a family of functions pertaining to selection of embroidery pattern data, and bears on its face a Graphic symbol indicative of such functions. This exclusive pictorial switch 21B is pressed, for example, at the time of selecting desired embroidery pattern data from a plural number of pattern data files in the memory area 18B of the processor unit 18.

The exclusive pictorial switch key 21C is allotted with a command for calling in a family of functions pertaining to manual operations, and bears on its face a Graphic symbol indicative of such functions. This exclusive pictorial key 21C is pressed, for example, at the time of stitching an applique part on the cloth or at the time of replacing the cloth holder frame.

The exclusive pictorial switch key 21D is allotted with a command which calls in functions pertaining to void or open stitching, and bears on its face a Graphic symbol indicative of such functions. Accordingly, the exclusive pictorial key 21D is pressed when it becomes necessary to form void stitches.

The exclusive pictorial switch key 21E is allotted with a command for controlling the rotational speed (r.p.m.) of the main shaft drive motor 3, and bears on its face a Graphic symbol indicative of such functions. Therefore, the exclusive pictorial key 21E is pressed when changing the rotational speed of the main shaft motor 3.

On the other hand, the exclusive pictorial switch key 21F is allotted with a command for controlling the color changing mechanism 8, and bears on its face a graphic symbol indicative of such functions. Accordingly, the exclusive pictorial key 21F is pressed when changing the color of the embroidering thread.

Further, the exclusive pictorial switch key 21G is allotted with a command for controlling the thread cutting mechanism 9, and bears on its face a graphic symbol indicative of such functions. This exclusive pictorial key 21G is pressed when it becomes necessary to cut embroidering threads in the middle of an embroidering operation.

Further, the exclusive pictorial switch key 21H is allotted with a command for controlling high speed color changes (e.g., alterations in color specifications and the like), and bears on its face a graphic symbol indicative of such functions. This exclusive pictorial key 21H is pressed when making changes in the embroidering thread color, for example, when sequentially or partly changing color specification data according to the colors of embroidering threads set on the bobbin holder plate.

The exclusive pictorial switch 21J is allotted with a command for switching the mode of operation between a preparatory mode and a running mode, and bears on its face a graphic symbol indicative of this function. Here, the term "running mode" means a mode in which the embroidering machine can be started at any time. That is, the embroidering machine can be started as soon as the operation on-off rod 11 is pushed ON after pressing the exclusive pictorial key 21J. The preparatory mode means a mode for setting up data of an embroidery pattern or for entering other settings in a preparatory stage prior to putting the embroidering machine in the running mode.

Indicated at 22A to 22D are auxiliary switch keys which are provided in a row on the top side of the operating panel 14. These auxiliary keys 22A to 22D are selectively allotted with commands in the memory area 18A of the processor unit 18, except the commands which are allotted to the exclusive pictorial keys 21A to 21J, in relation with and in submission to selection by the operator of a command allotted to one of the exclusive pictorial keys 21A to 21J.

Denoted at 23A to 23E are frame moving switch keys which are manipulated by the operator for manually moving the cloth holder frame 5. Indicated at 24A and 24B are power switches, namely, a power-on switch and a power-off switch, respectively.

The display 15 is constituted by an LCD (liquid crystal display) or a CRT which is capable of displaying characters and graphic symbols or patterns on its viewing screen. The screen of the display 15 is divided into a lower menu area 15A and an upper message area 15B by means of a display drive software.

The lower menu area 15A is divided into four square sections which are located closely and correspondingly on the upper side of the four auxiliary switch keys 22A t0 22D, the respective sections of the menu area 15A serving to show in graphic symbols a menu of commands which are currently allotted to the respective auxiliary switch keys 22A to 22D as illustrated in FIGS. 8 to 11. On the other hand, if one of the exclusive pictorial switch keys 21A to 21J or one of the auxiliary switch keys 22A to 22D is pressed by the operator to select a command to be executed, a graphic symbol of the selected command is shown in the message area 15B of the display 15 as illustrated in FIGS. 8 to 11.

In this connection, the term "command" as used in the preceding and succeeding descriptions means a processing command for calling in a specific function or a specific family of functions of the controller 12 or of the embroidering machine, and a command for each function is stored in the memory area 18A of the processor unit 18 in a one-on-one fashion. As mentioned hereinbefore, among the various commands, the most frequently used commands are allotted to the exclusive pictorial switch keys 21A to 21J, while other commands are selectively allotted to the auxiliary switch keys 22A to 22D depending upon the selection of a specific command or a specific family of commands. Accordingly, the content of a selected command is executed as soon as a corresponding one of the exclusive pictorial switch keys 21A to 21J or of the auxiliary switch keys 22A to 22D is pressed by the operator to key in an aimed command.

The Graphic symbols are correspondingly provided at the respective commands. The graphic symbols are graphed ones which are functions operating by the selection of the respective commands and which are imaged in connection with the functions.

The Graphic symbols of the command which are allotted to the exclusive pictorial switch keys 21A to 21J are printed on the faces of the latter as mentioned hereinbefore. On the other hand, the graphic symbols of the commands which are selectively allotted to the auxiliary switch keys 22A to 22D are shown in the menu area 15A of the display 15 as a graphic menu. Namely, a set of graphic data is stored in the memory area 18A of the processor unit 18, including data for the graphic symbols of commands as shown in FIG. 4. Upon pressing one of the exclusive pictorial switch keys 21A to 21J, a graphic menu is shown in the menu area 15A of the display 15, the graphic menu being in the form of a row of graphic symbols of commands which have been allotted to the auxiliary switch keys 22A to 22D according to a keying operation on an exclusive pictorial switch key.

Figure 8:
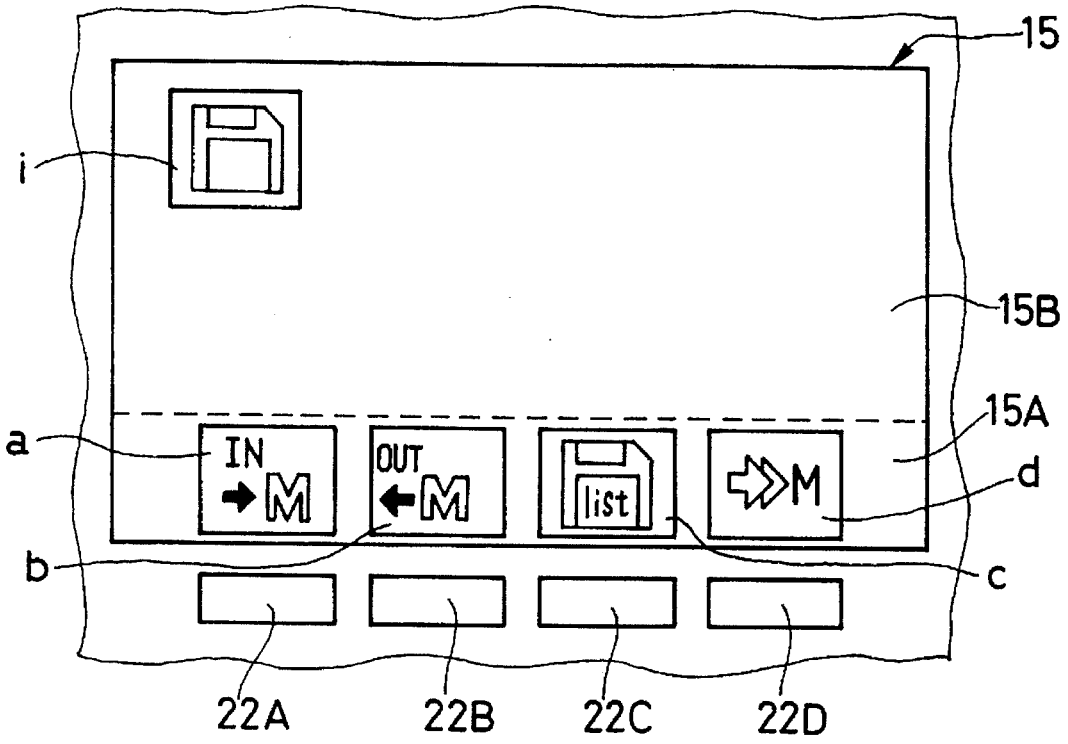
FIG. 8 is a diagrammatic illustration of a viewing screen of a display means, showing a graphic screen guide for a data setting operation, for example, at the time of an embroidery pattern data input/output operation.
Figure 9:
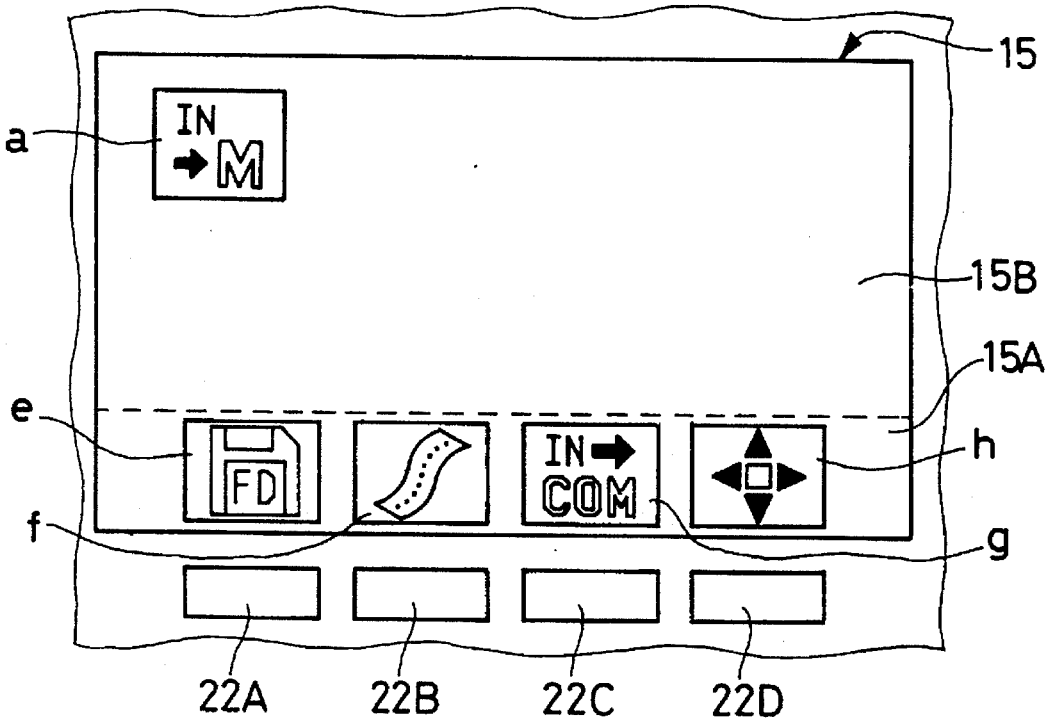
FIG. 9 is a diagrammatic illustration of the viewing screen of the display means, showing a graphic screen guide at the time of an embroidery pattern data uploading operation.

For instance, when the exclusive pictorial switch key 21A, which is allotted with a command pertaining to embroidering data setup functions, is pressed by the operator, a set of embroidery pattern data input/output commands are allotted to the auxiliary switch keys 22A to 22D in submission to the selection of the exclusive pictorial switch 21A, while generating a graphic menu and a graphic message on the display screen as illustrated in FIGS. 8 and 9 in response to the keying operation by the operator.

In the stage of FIG. 8, graphic symbols (a) to (d) are shown in the menu area 15A of the display 15 as a menu of functions to be chosen from, while a graphic symbol (i) of the selected function family is shown in the message area 15B of the display 15. In the stage of FIG. 9, graphic symbols (e) (h) are shown in the menu area 15A of the display 15 as a graphic menu of functions to be chosen from, while the graphic symbol (a) is shown in the message area 15B of the display 15 as a graphic guide message in response to the keying operation by the operator.

More particularly, FIG. 8 shows a stage where a graphic menu for embroidery pattern data input/output functions is shown in the menu area 15A of the display 15 by way of graphic symbols of the respective functions. On this embroidery pattern data input/output menu, the auxiliary switch key 22A is allotted with a command in control of a function of uploading pattern data into the memory area 18B from an embroidery pattern data storage medium, and the graphic symbol (a) indicative of this function is shown in the menu area 15A at a position immediately above the auxiliary switch key 22A. The next auxiliary switch key 22B is allotted with a command in control of a function of downloading or saving embroidery pattern data in the memory area 18B to other pattern data storage medium, for example, to a floppy disk or punching tape, and a graphic symbol (b) indicative of this function is shown in the menu area 15A at a position immediately above the auxiliary switch key 22B. The next auxiliary switch key 22C is allotted with a command in control of a function of listing file numbers of embroidery patterns on a floppy disk along with names of embroidery patterns and numbers of needles, and a graphic symbol (c) indicative of this function is shown in the menu area 15A at a position immediately above the auxiliary switch key 22C. Further, the auxiliary switch key 22D is allotted with a command in control of a function of writing additional or supplemental data into the memory, and a graphic symbol (d) indicative of this function is shown in the menu area 15A at a position immediately above the auxiliary switch key 22D.

In addition to the graphic menu, a graphic message (i) is shown in the message area 15B of the display 15, indicating the current stage (FIG. 8) of the setup operation which is now under the menu for embroidery pattern data input/output functions as a result of the keying operation on the exclusive pictorial switch 21A in the previous stage.

FIG. 9 shows a stage where the contents of graphic guides in the menu and message areas of the display screen have been advanced from FIG. 8 as a result of a keying operation on the auxiliary switch key 22A under the menu of FIG. 8. Namely, in the stage of FIG. 9, the auxiliary switch key 22A is allotted with a command in control of a function of uploading embroidery pattern data from the disk drive 16, and a graphic symbol (e) indicative of this function is shown in the menu area 15A at a position immediately above the auxiliary switch key 22A. The auxiliary switch key 22B is allotted with a command in control of a function of uploading or downloading embroidery pattern data through the tape reader 19 or tape puncher 20, and a graphic symbol (f)

indicative of this function is shown in the menu area 15A at a position immediately above the auxiliary switch key 22B. Nextly, the auxiliary switch key 22C is allotted with a command in control of a function of transmitting embroidery pattern data to or from an external data management unit, and a graphic symbol (g) indicative of this function is shown in the menu area 15A at a position immediately above the auxiliary switch key 22C. Further, the auxiliary switch key 22D is allotted with a command in control of a function of adding alterations to embroidery pattern data in the memory while manually shifting the position of the cloth holder frame 5 for this purpose, and a graphic symbol (h) indicative of this function is shown in the menu area 15A at a position immediately above the auxiliary switch key 22D.

At the same time, a graphic message (a) is shown in the message area 15B of the display 15, indicating the current status (FIG. 9) of the setup operation which is now under the menu for embroidery pattern data input functions as a result of the keying operation in the previous stage.

Now let us consider another case where in an initial stage of a setup operation the operator presses the exclusive pictorial switch key 21F which is allotted with a command pertaining to the control of the color changing mechanism 8. In this case, in submission to the selection of the exclusive pictorial switch key 21F, a set of commands which are necessary for the control of the color changing mechanism 8 are allotted to the auxiliary switch keys 22A, 22B and 22D. As a result, as illustrated in FIG. 11, the display 15 shows a graphic menu consisting of graphic symbols (j), (k) and (m) of the allotted functions in its menu area 15A, and a graphic message of graphic symbols (n) and (p) in its message area 15B.

Figure 11:
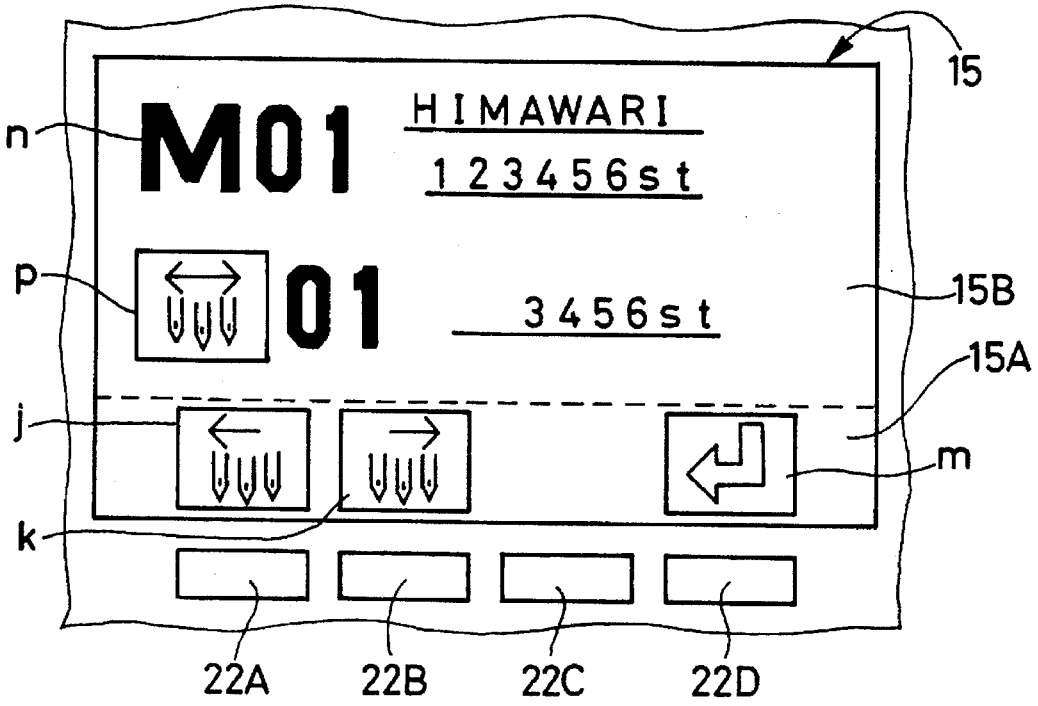
FIG. 11 is a diagrammatic illustration of the viewing screen of the display means, showing a graphic screen guide at the time of operating a color changing mechanism.

More specifically, in the example shown in FIG. 11, the auxiliary switch key 22A is allotted with a command for directly operating the color changing mechanism 8 in a forward direction, while the auxiliary switch key 22B is allotted with a command for directly operating the color changing mechanism 8 in a reverse direction. Therefore, an embroidering needle 7 in a particular position (a needle with a thread of a particular color) can be selected on each machine head 2 by operating the auxiliary switch keys 22A and 22B graphic symbols (j) and (k) indicating the directions of operation are shown in the menu area 15A at positions immediately above the auxiliary switch keys 22A and 22B, respectively. The auxiliary switch key 22D is allotted with a command (a definitive command) for executing a function of saving, in the memory area 18B of the processor unit 18, an alteration in embroidering needle number entered by operating the auxiliary switch keys 22A and 22B, and a graphic. symbol (m) indicative of this function is shown in the menu area 15A at a position immediately above the auxiliary switch key 22D. In this case, no command is allotted to the auxiliary switch key 22C.

At the same time, the display 15 shows in its message area 15B a graphic symbol (n) indicating that an embroidery pattern data file "No. 01" is in the memory area 18B, and a graphic symbol (p) indicating that an embroidering needle of "No. 01" is selected on the color changing mechanism 8, along with other data such as the name of the embroidery pattern in the file, number of stitches or any other information which may be necessary in controlling embroidering operations.

The graphic symbols which are stored in the memory area 18A of the processor unit 18 may include symbolic letters, characters or notations in addition to a pictorial element or elements. The included letters or characters, if any, should be of the sort which is universally comprehensible despite the language barriers between different countries. What is meant by the letters "IN" in the graphic symbols (a) and (g) of FIG. 4 or by the letters "OUT" in the graphic symbol (b) can be readily understood by almost any operator even if his or her mother tongue is not English. In some cases, the included letters are an abbreviation of a technical term which is generally used in the art. For example, the letters "MSU" in the graphic symbol (r) in FIG. 4 is an abbreviation of "Machine Set UP" and the letters "MC" in the graphic symbol (s) is an abbreviation of "Machine Condition". These abbreviations are in common use in the art, so that they can be instantly understood by the operator at a glance.

Shown in FIG. 4 is an example of graphic symbols stored in the memory area 18A of the processor unit 18, along with other graphic symbols to be used in the menu and message areas: in connection with other functions such as "Scale Up", "Scale Down", "Alternate Mirror-Image Stitching (Spot Pattern stitching on Socks)", "Pattern Reversal", "Pattern Arrangement", "Perforations", "Cap Frame", "Cloth Feed", "Frame Limits", "Embroidery Pattern Graphics" etc.

Now, the operations by the above-described embodiment of the embroidery machine controller according to the invention are described with reference to the flowcharts of FIGS. 5 to 7.

The flowchart of FIG. 5 shows a preparatory processing for setting up necessary data in a preparatory stage prior to starting an embroidering operation.

Upon turning on the controller by pressing the power switch 24A, an initializing routine is executed in a manner well known in the art before going to the preparatory setup processing shown in FIG. 5.

This preparatory processing is started when one of the exclusive pictorial switch keys 21A to 21J is pressed in Step 1.

The processing then goes to Step 2 to determine whether or not the command allotted to the pressed exclusive pictorial key is of the nature which requires to put any one of drive mechanisms of the embroidering machine instantly in operation.

If the judgement in Step 2 is "YES", the processing proceeds to Step 3 to execute the selected command, showing the graphic symbol of the command in the message area 15B of the display 15, and then to Step 4 to execute instantly the function under the command.

For instance, it is assumed here that the exclusive pictorial switch key 21G is allotted with a command which requires to operate the thread cutting mechanism 9 at once, and the exclusive pictorial switch key 21G is pressed in Step 1 of the preparatory processing. In such a case, the judgement in Step 2 is "YES", so that the processing proceeds to Steps 3 and 4, actually putting the thread cutting mechanism 9 in operation right away. After execution of a thread cutting operation, the processing returns to Step 1.

On the other hand, for example, there may be a case where the exclusive pictorial switch key 21A is pressed in Step 1 of the preparatory processing. In such a case, a judgement "NO" comes out in Step 2, so that the processing proceeds to Step 5, allotting the auxiliary switch keys 22A to 22D with a family of commands submissive to the exclusive pictorial switch key 21A, and showing in the menu area 15A of the display 15 a graphic menu of the allotted commands and in the message area 15B a guide message of a graphic symbol responsive to the keying operation.

In this particular example, upon pressing the exclusive pictorial switch key 21A, a graphic menu which consists of graphic symbols (a), (b), (c) and (d) as shown in FIG. 8, appears in the menu area 15A of the display 15.

Consequently, under the guidance of the graphic symbols (a) to (d), the operator can readily choose a correct key for an intended function. Namely, the graphic symbols (a) to (d), which are displayed closely in corresponding positions relative to the auxiliary switch keys 22A to 22D, unmistakably indicate the contents of the commands which are currently allotted to the respective auxiliary switch keys 22A to 22D. In this instance, as described hereinbefore, the Graphic symbol (a) indicates that the auxiliary switch key 22A is allotted with a command for uploading embroidery pattern data. Besides, a graphic guide message in the form of a graphic symbol (i) is shown in the message area 15B of the display 15. The graphic symbol (i) gives a message that the exclusive pictorial switch key 21A has been pressed to open a menu of embroidery pattern data input/output functions. Namely, in order to let the operator recognize the current status easily, the graphic symbol (i) which is shown in the message area 15A of the display 15 is identical with that on the face of the exclusive pictorial switch key 21A.

If any one of the auxiliary switch keys 22A to 22D is pressed in Step 6, a check is made in Step 7 as to whether or not the command allotted to the pressed auxiliary switch key is a definitive command. If "NO", the processing returns to Step 5, and, if "YES", the processing proceeds to Step 8. The term "definitive command" will be explained hereinlater.

For example, in case a file of embroidery pattern data is uploaded to the memory area 18B of the processor unit 18 from a floppy disk on the disk drive 16, the processing from Step 5 to Step 7 proceeds in the manner as follows. More specifically, in the particular example given below, a file of embroidery pattern data No. 10 (hereinafter referred to simply as "pattern No. 10" for brevity) is uploaded to the memory area. 18B under a file name "pattern No. 01" from a floppy disk. In this instance, it is assumed that the floppy disk holds 36 embroidery pattern data files from Pattern No. 01 to Pattern No. 36, and that the memory area 18B on the side of the processor unit 18 is capable of storing 10 different embroidery pattern data files from No. 1 to No. 10.

Firstly, the exclusive pictorial switch key 21A is pressed to open a menu of pattern data input/output functions, whereupon the processing proceeds to Step 2 and then to Step 5, showing the corresponding graphic menu and message on the display 15 as shown in FIG. 8.

For selecting the function of uploading an embroidery pattern data file to the memory area 18B of the processor unit 18 from a floppy disk on the disk drive, what the operator needs to do is simply to press the auxiliary switch key 22A (Step 6) under the Guidance of the graphic menu.

Whereupon, in order to determine an input medium, the processor unit 18 produces a judgement "NO" in Step 7 and Goes back to Step 5, renewing the graphic menu and message on the display screen as illustrated in FIG. 9. Namely, as seen in FIG. 9, in Step 5 the processor unit 18 generates a graphic menu consisting of the graphic symbols (e), (f), (g) and (h) of different input media in the menu area 15A of the display 15 correspondingly to the auxiliary switch keys 22A to 22D, respectively, and a guide message of a graphic symbol (a) in the message area 15B. Consequently, a menu for selection of an input medium is opened at the stage shown in FIG. 9.

Figure 10:
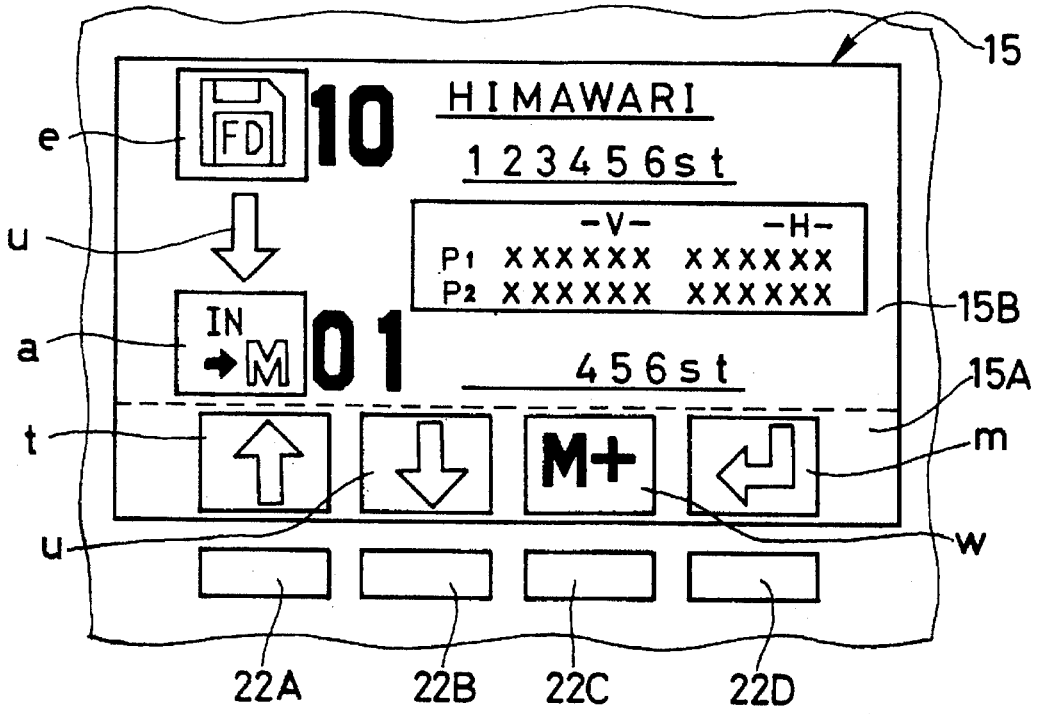
FIG. 10 is a diagrammatic illustration of the viewing a graphic screen guide on the display screen in a stage subsequent to FIG. 9 in the embroidery pattern data uploading operation.

Now, if the operator presses the auxiliary switch key 22A to select the floppy disk as an input medium (Step 6), the controller 18 produces a judgement "NO" in Step 7 for advancing the setup process to a stage for selecting the pattern No. on the floppy disk and the pattern No. in the memory area 18B, and then goes to Step 5, renewing the graphic menu and message as shown in FIG. 10. More specifically, in the stage of FIG. 10, a pattern number selection menu consisting of graphic symbols (t), (u), (w) and (m) is shown in the menu area 15A of the display 15 correspondingly to the auxiliary switch keys 22A to 22D, respectively.

In the stage illustrated in FIG. 10, the auxiliary switch key 22A is allotted with a command (represented by graphic symbol (t)) in control of a function of selecting a file of embroidery pattern data to be uploaded, by calling in one after another the pattern numbers of a plural number of embroidery pattern data files on the floppy disk in an incremental direction. Nextly, the auxiliary switch key 22B is allotted with a command (represented by graphic symbol (u)) in control of a function of selecting a file of embroidery pattern data to be uploaded, by calling in one after another the pattern numbers of a plural number of embroidery pattern data files on the floppy disk in a decremental direction. Further, the auxiliary switch key 22C is allotted with a command (represented by graphic symbol (w)) in control of a function of selecting a pattern number to be tagged to the uploading embroidery pattern data file. Namely, the processor unit 18 is arranged to store a plural number of embroidery pattern data files in the memory area 18B in such a way that, among a variety of stored embroidery patterns, data of a desired embroidery pattern file can be set up by selecting a corresponding pattern number through operation of the auxiliary switch keys 22A to 22D. The remaining auxiliary switch key 22D is allotted with a definitive command (represented by graphic symbol (m)) for definitely entering (registering) the data which have been keyed in on the current menu.

In the stage shown in FIG. 10, the operator searches for a pattern number of a desired embroidery pattern by operating the auxiliary switch keys 22A to 22C (repeating from Step 5 to Step 7). After choosing a pattern number of a desired embroidery pattern from a variety of embroidery pattern data stored on the floppy disk, the operator presses the auxiliary switch key 22D (Step 6). Accordingly, if the auxiliary switch key 22D of a definitive command is pressed, a judgement "YES" is issued in Step 7, and the processing proceeds to Step 8.

In step 8, in response to the preceding keying operation, graphic symbols (e), (u) and (a) are shown in the message area 15B to notify that the specified file of embroidery pattern data is being uploaded to the memory area 18B of the processor unit 18 from the floppy disk, along with necessary numerical data. In this instance, the graphic symbol (e) is accompanied by figures "10" indicating that a pattern No. 10 on the floppy disk has been selected, while the graphic symbol (a) is accompanied by figures "01" indicating that the selected file of embroidery pattern data is being uploaded into the memory area 18A as pattern No. 01. Namely, at the message level shown in FIG. 10, the message area 15B of the display shows that a data file of pattern No. 10 on the floppy disk is being uploaded to an address for pattern No. 01 on the part of the memory area 18B, together with other necessary information including the pattern name "HIMAWARI(sunflower)", number of stitches "123456st", data (coordinates) of maximum positions P1 and P2 and so forth.

Succeedingly in Step 9, the disk drive 16 is put in operation to upload the selected pattern data into the memory area 18B of the processor unit 18, and then the processing proceed to Step 10 to return.

After finishing in this manner the necessary preparatory settings prior to an operation, the operator presses the pictorial exclusive switch 21J in order to switch the controller into a running mode in which the operation of the embroidering machine can be started as soon as the operator pushes the operation on-off rod 11 in the ON-direction, whereupon the embroidering needles 7 on the respective machine heads 2 are put in reciprocating motions to form stitches on and through the embroidering cloth on the cloth holder frame 5.

Shown in FIGS. 6 and 7 are flowcharts of an in-operation processing, for example, for suspending an embroidering operation to cut embroidering threads and change the color.

Firstly, in Step 11, the main shaft motor 3 is stopped as the operation rod 11 is pushed OFF to suspend the operation of the embroidering machine.

Then, in Step 12, one of the exclusive pictorial switch keys 21A to 21J is selectively pressed by the operator.

The processing then goes to Step 13 to determine whether or not the command allotted to the pressed exclusive pictorial switch key is of the nature which requires to actuate instantly any one of the drive mechanisms of the embroidering machine.

If the judgement in Step 13 is "YES", the processing goes to Step 14 to execute the selected command instantly, while showing as a message a graphic symbol of the command in the message area 15B of the display 15. Therefore, the function under this command is performed at once in Step 15.

For instance, in case the operator presses the exclusive pictorial switch key 21G which is allotted with a command for the control of the thread cutting mechanism 9, a judgement "YES" comes out in Step 13 and therefore the processing Goes to Steps 14 and 15 to actuate the thread cutting mechanism 9 instantly. Thereafter, the processing proceeds to Step 22.

Alternatively, in case the exclusive pictorial switch key 21F in command of the color changing mechanism 8 is pressed in Step 12, a judgement "NO" comes out in Step 13 and therefore the processing goes to Step 16, switching the graphic screen guide to the level of FIG. 11. Therefore, in Step 16, a variety of commands submissive to the command of the exclusive pictorial switch key 21F are allotted to the auxiliary switch keys, 22A, 22B and 22D showing a graphic menu containing graphic symbols (j), (k) and (m) of the allotted commands in the menu area 15A of the display 15 as illustrated in FIG. 11. In this instance, as described hereinbefore, the auxiliary switch keys 22A, 22B and 22D are allotted with commands for directly operating the color changing mechanism 8. Simultaneously, a message in the form of graphic symbols such as the graphic symbols (n) and (p) is also shown in the message area 15B of the display 15, along with necessary numerical data.

Then, if either one of the auxiliary switch keys 22A or 22B is pressed in Step 17, the command of the pressed auxiliary switch key is checked in Step 18 as to whether or not it is a command calling for an immediate operation of a drive mechanism of the embroidering machine. If the judgement in Step 18 is "YES", the processing proceeds to Step 19 to execute the selected command while showing a message in the form of a graphic symbol of the function corresponding to the selected command in the message area 15B of the display 15, and then to Step 20 to actuate instantly a drive mechanism or other component part specified by the command.

For instance, in case of the example shown in FIG. 11, no matter which one of the auxiliary switch keys 22A and 22B is pressed, a judgement "YES" comes out in Step 18, and the processing proceeds to Steps 19 and 20, instantly putting the color changing mechanism 8 in operation in Step 20 to change the embroidering needle 7 on each machine head 2 for a needle of a different thread color. After this, the processing proceeds to Step 22.

On the other hand, in case a judgement "NO" comes out in Step 18, the processing proceeds to Step 21, renewing graphic menu and message on the display 15 according to the command allotted to the auxiliary switch key 22A to 22D which was pressed in Step 17.

The processing then goes to Step 22 to check whether or not any one of the exclusive pictorial switch keys 21A to 21H or any one of the auxiliary switch keys 22A to 22D has been pressed. In case any one of these switch keys is pressed, the processing proceeds to Step 23. A judgement "YES" comes out in Step 23 to let the processing return to and repeat from Step 13 if the pressed key is one of the exclusive pictorial switch keys 21A to 21H, and a judgement "NO" comes to let the processing to return to and repeat from Step 18 if the pressed key is one of the auxiliary switch keys 22A to 22D.

Figure 12:
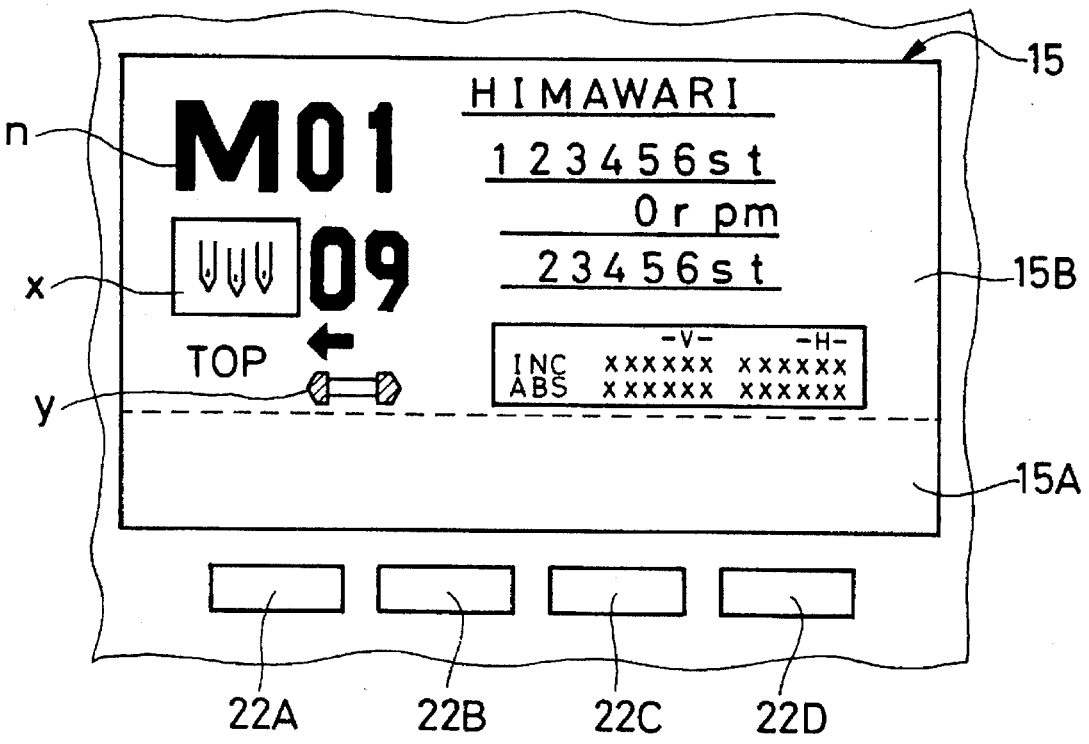
FIG. 12 is a diagrammatic illustration of the viewing screen of the display means, showing a graphic screen guide immediately before restarting an embroidering operation.

Upon finishing a thread cutting operation, a thread replacing or other operation of the embroidering machine by repeating the processing from Step 13 to Step 23, a graphic message as in FIG. 12 is put on the message area 15B of the display 15. More particularly, the graphic message which appears at this time on the message area 15B of the display 15 consists of graphic symbols (n), (x) and (y). The graphic symbol (n) is accompanied by figures "01" indicating "pattern No. 01", the graphic symbol (x) is accompanied by figures "09" indicating "needle No. 09", and the graphic symbol (y) indicating that the embroidering machine can be restarred by pushing the operation on-off rod 11. Further, the letters "TOP", "V", "H", "INC" and "ABS" on the message area 15B of the display at the graphic guidance level of FIG. 12 are a sort of graphic symbols which are universally adopted in the art.

Then, the processing proceeds to Step 24 in case the operator intends to restart the operation of the embroidering machine, and the operation on-off rod 11 is pushed ON in Step 24. Consequently, the embroidering operation is restarred in Step 25.

Thus, according to the above-described embodiment of the invention, the operation panel 14 is provided with exclusive pictorial switch keys 21A to 21J which bear on their faces graphic symbols of the exclusively allotted commands, in combination with auxiliary switch keys 22A to 22D which are allotted with commands selectively in submission to a keying operation on one of the exclusive pictorial switch keys 21A to 21J, and the display 15 which is arranged to show, in its menu area, a graphic menu composed of graphic symbols indicative of the contents of the commands allotted to the respective auxiliary switch keys 22A to 22D and, in its message area 15B, a graphic guide message based on a key operation on any one of the various switch keys. As a result, simply by selectively pressing the exclusive pictorial switch keys 21A to 21J, the operator can unmistakably execute the functions which are frequently used in controlling operations of an embroidering machine. Besides, by way of the graphic symbols which are printed on the faces of the exclusive pictorial switch keys 21A to 21J, the operator can easily apprehend the contents of the commands (functions) which are currently allotted to the respective exclusive pictorial switch keys 21A to 21J.

Consequently, the operability of the controller 12 is improved to a marked degree, permitting the operator to make settings for an embroidering operation very quickly through the controller 12. In addition, the functions which are regularly used by an operator in the course of an embroidering operation can be executed simply by pressing the exclusive pictorial switch keys 21A to 21J, which can be operated easily even by an unskilled operator.

Further, a graphic menu consisting of graphic symbols of the commands which are currently allotted to the auxiliary switch keys 22A to 22D, is shown in the menu area 15A of the display 15, permitting the operator to grip the contents of each of the allotted commands easily at a glance and thus contributing also to improve the operationability of the controller to a marked degree.

Moreover, thanks to the message by way of a graphic symbol or symbols which are shown in the message area 15B of the display 15 according to a keying operation on any one of the exclusive pictorial switch keys 21A to 21J or any one of the auxiliary switch keys 22A to 22D, the operator can grip the contents of the message instantly in such a way as to ensure smooth dialogues with the controller 12 in addition to improvements in operationability.

Further, the graphic guides to the contents of the commands allotted to the exclusive pictorial switch keys 21A to 21J or auxiliary switch keys 22A to 22D and to the contents of the messages on the display 15 by means of graphic symbols (or graphic patterns) make it very easy for the operator to understand the contents of the respective commands, menu and message irrespective of his or her mother tongue. Namely, the controller 12 can be Operated easily by a foreign operator. Accordingly, there will arise no necessity for changing programs for the graphic screen guides on the display 15 into conformity with the mother tongue of the operator, permitting to cut the production cost of the controller in addition to the simplification of operational procedures.

Furthermore, the respective commands in the menu and messages are characterized either by symbolic graphic patterns or by universally comprehensible letters or figures with or without graphic or pictorial elements, thereby ensuring better understanding of the contents of the commands, menu and messages by the operator and making the keying operations easier.

In the flowchart of FIG. 5, the operation in Step 5 constitutes the graphic menu generating means which is one essential element in the above-described embodiment of the invention, while operations in Steps 3, 5 and 8 constitute the graphic message generating means. On the other hand, in the flowcharts of FIGS. 6 and 7, the operation in Step 16 constitutes the essential graphic menu generating means, and the operations in Steps 14, 16, 19 and 21 constitute the graphic message generating means.

Although the above-described embodiment is arranged to show a graphic message and/or numerical data in the message area 15B of the display 15, arrangements may also be made to show a selected embroidery pattern graphically in the message area upon keying in a pattern display command. Namely, embroidery patters can also be handled as part of the graphic symbols or patterns for the graphic screen guide if necessary.

Figure 13:
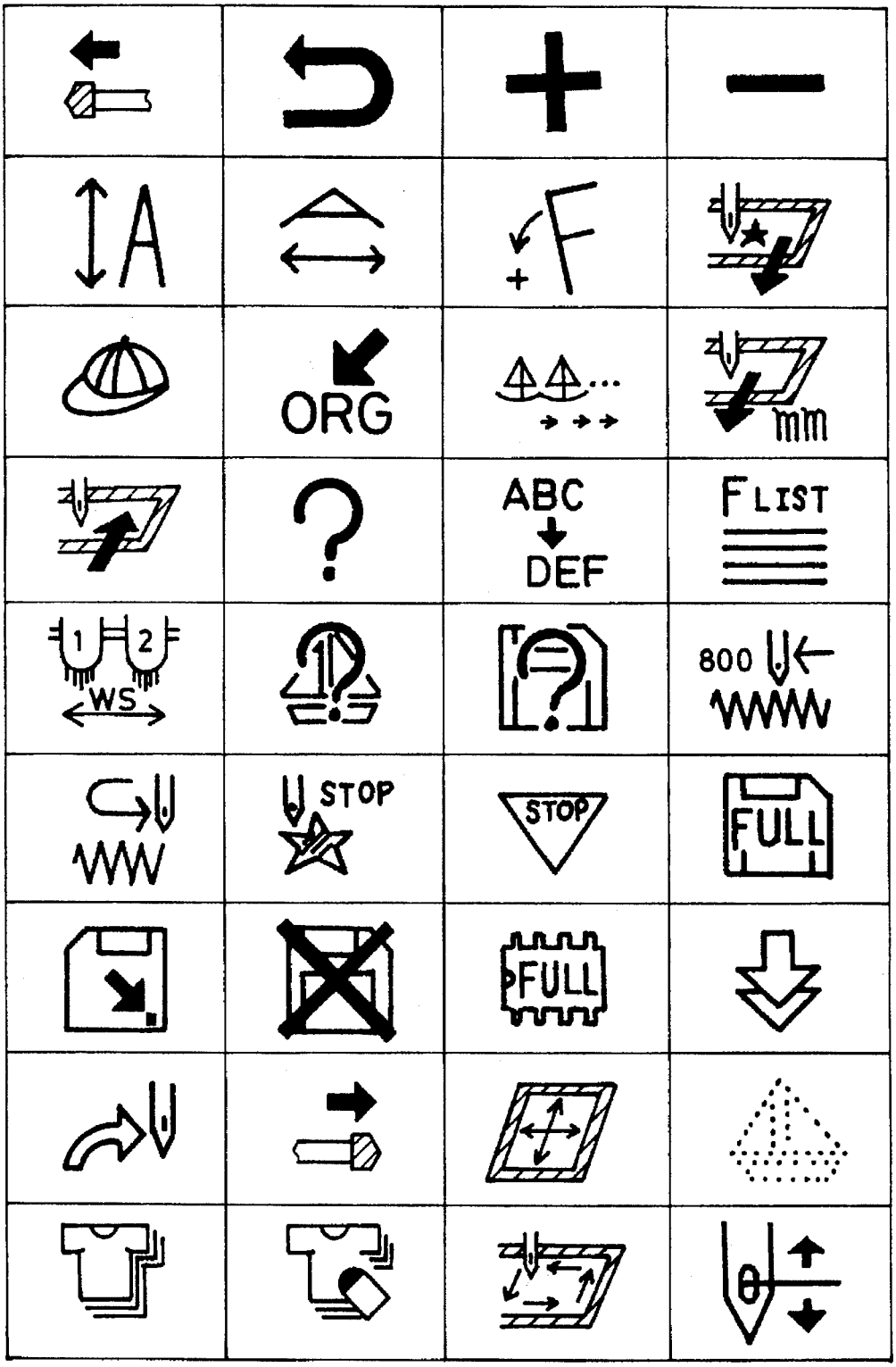
FIG. 13 is a diagrammatic illustration of other graphic symbols or patterns which can be suitably employed in the embodiment of the invention.

Besides, a variety of graphic symbols or patterns, other than the particular examples shown above, can be created by the use of graphically designed letters and pictorial messages depending upon the purpose of the graphic guide to be put on the display. By way of example, FIG. 13 shows other graphic symbols and messages which can be employed for the graphic screen guides.

The controller 12 which is described as being mounted on the support table 1 in the foregoing embodiment, may be located in other places. For instance, if desired, it may be installed in a separate place from the support table 1 of the embroidering machine, and connected to the embroidering machine proper through a cable and a communication line.

Further, needless to say, the present invention is applicable not only to a controller for a multi-head embroidering machine but to a controller for a single head embroidering machine.

Furthermore, in the above-described embodiment, the operation panel 14 of the controller 12 is provided with nine exclusive pictorial switch keys 21A to 21J which are exclusively allotted with commands for calling in a function or a family of functions pertaining to "Embroidering Data Input/Output", "Embroidery Pattern Data Selection", "Manual Operation", "Void Stitching", "Main Shaft Motor Speed Control", "Color Change", "Thread Cutting", "High Speed Color Change", "Operation Mode", respectively. However, more than 10 exclusive pictorial switch keys, or eight or seven exclusive pictorial switch keys may be provided on the operation panel 14 according to the number of functions required by the embroidering machine. Similarly, instead of four auxiliary switch keys, there may be provided 3 or more than 5 auxiliary switch keys if desired.

Industrial Applicability

As clear from the foregoing detailed description, the embroidering machine controller according to the present invention includes a memory means storing a large number of commands necessary for controlling operations of an embroidering machine, a plural number of exclusive pictorial switch keys exclusively allotted with most frequently used commands among the large number of commands stored in the memory means, a plural number of auxiliary switch keys selectively allotted with commands in relation with and in submission to a selecting operation on one of the exclusive pictorial switch keys from the large number of commands stored in the memory means except the commands allotted to the exclusive pictorial switch keys, a display means for graphic screen guide, having a menu area to display a graphic menu of commands currently allotted to the respective auxiliary switch keys, and a graphic menu generating means for displaying graphic menu of the allotted commands in the menu area of the display means in positions corresponding to the respective auxiliary switch keys. Thus, since the exclusive pictorial switch keys are allotted with commands pertaining to functions which are most frequently used in the course of controlling operations of an embroidering machine, the operator can get to and execute a desired function smoothly by pressing a corresponding exclusive pictorial switch key.

Besides, the faces of the exclusive pictorial switch keys bear graphic symbols of the allotted commands, so that the operator can readily recognize the roles played by the respective exclusive pictorial switch keys at a glance. On the other hand, the graphic symbols of the commands which have been selectively allotted to the respective auxiliary switch keys in response and in submission to a keying operation on an exclusive pictorial switch key are shown in the menu area of the display means positionally in one-on-one relation with the auxiliary switch keys, facilitating the recognition of the contents of a command to be keyed in while ensuring easy operations of the auxiliary switch keys even by an unskilled operator.

The display means may further include a graphic message generating means to show a graphic guide message on its viewing screen outside the menu area in response to a keying operation on any one of the exclusive pictorial switch keys or any one of the auxiliary switch keys, thereby further assisting the operator in gripping clearly the contents of a command being executed and accelerating accurate dialogues between the operator and the machine.

Moreover, all the graphic guides, including the graphic symbols on the faces of the exclusive pictorial switch keys, the graphic menu shown in the menu area of the display means as a graphic guide to the auxiliary switch keys, and the graphic message shown in the message area of the display in response to a keying operation by the operator, are a great assistance to the operator in gripping the contents of the commands which are allotted to the respective switch keys and in comprehending the contents of the menu and message on the display means irrespective of his or her mother tongue.

We claim:

1. An embroidering machine controller for producing embroidery patterns by controlling actuators on an embroidering machine according to setup embroidering data, said controller comprising;

a memory means storing a large number of commands for the control of various functions necessary for controlling operations of said embroidering machine;

a plural number of exclusive pictorial switch keys allotted exclusively with most frequently used commands among the large number of commands stored in said memory means and each bearing a pictorial symbol of an exclusively allotted command on a face thereof;

a plural number of auxiliary switch keys selectively allotted with the remainder of the large number of commands other than the commands exclusively allotted to said exclusive pictorial switch keys, in relation with and in submission to a keying operation on one of said exclusive pictorial switch keys;

a display means having a menu area on a viewing screen to show a menu of commands allotted to the respective ones of said auxiliary switch keys in response to a keying operation on one of said exclusive pictorial switch keys; and a graphic menu generating means for generating in said menu area of said display means a set of graphic symbols of the commands currently allotted to said respective auxiliary switch keys in position corresponding to the latter.

2. An embroidering machine controller as defined in claim 1, further comprising a message area provided on said viewing screen of said display means outside said menu area, for displaying a guide message pertaining to a selected command, and a graphic message generating means adapted to produce a graphic symbol of said selected command as a graphic guide message in said message area of said display means in response to a keying operation either on one of said exclusive pictorial switch keys or on one of said auxiliary switch keys.

3. An embroidering machine controller as defined in claim 2, wherein in addition to said graphic symbol of said selected command, said graphic message generating means is arranged to indicate the meaning or contents of said selected command by adding simple universally comprehensible letters, figures or characters to said graphic symbol.

4. An embroidering machine controller as defined in claim 1, wherein said exclusive pictorial switch keys are each allotted with a command for calling in exclusively a function or a family of functions pertaining to embroidering data input/output control embroidery pattern selection, manual operation, void stitching main shaft drive motor control, color change, thread cutting, high speed color change and operation mode, and each one of said exclusive pictorial switch key bears on a face a pictorial or graphic symbol indicative of an exclusively allotted function or function family.

* * * * *